US009485847B1

(12) United States Patent
Umstadter

(10) Patent No.: US 9,485,847 B1
(45) Date of Patent: Nov. 1, 2016

(54) METHOD OF ALIGNING A LASER-BASED RADIATION SOURCE

(71) Applicant: Board of Regents of the University of Nebraska-Lincoln, Lincoln, NE (US)

(72) Inventor: Donald Umstadter, Lincoln, NE (US)

(73) Assignee: NUtech Ventures, Lincoln, NE (US)

( * ) Notice: Subject to any disclaimer, the term of this patent is extended or adjusted under 35 U.S.C. 154(b) by 414 days.

(21) Appl. No.: 14/212,787

(22) Filed: Mar. 14, 2014

Related U.S. Application Data

(60) Provisional application No. 61/781,287, filed on Mar. 14, 2013.

(51) Int. Cl.
*H05G 2/00* (2006.01)

(52) U.S. Cl.
CPC ..... *H05G 2/008* (2013.01); *H05G 2/001* (2013.01); *H05G 2/003* (2013.01)

(58) Field of Classification Search
CPC ..... H05G 2/001; H05G 2/003; H05G 2/008
See application file for complete search history.

(56) References Cited

U.S. PATENT DOCUMENTS 5,637,966 A * 6/1997 Umstadter ..... G21K 1/003 315/111.81
2005/0147147 A1* 7/2005 Umstadter ..... H01S 3/30 372/73

* cited by examiner

*Primary Examiner* — Glen Kao
(74) *Attorney, Agent, or Firm* — Picadio Sneath Miller & Norton, P.C.; Robert L. Wagner

(57) ABSTRACT

A method for temporally and spatially aligning a laser-based x-ray source and maintaining alignment is disclosed. A pump laser beam, which interacts with a plasma source to create an electron beam, is aligned with the electron beam. A scattering laser beam is overlapped with the pump laser beam at an intersection point. The pump laser beam and scattering laser beam alignments are monitored and adjusted to maintain optimal alignment during operation of the laser-based x-ray source.

37 Claims, 7 Drawing Sheets

METHOD OF ALIGNING A LASER-BASED RADIATION SOURCE

RELATED APPLICATION

The present application claims the benefit of U.S. Provisional Patent Application No. 61/781,287, filed on Mar. 14, 2013, the contents of which are hereby incorporated by reference.

This invention was made with government support under contract HDTRA1-11-C-0001 awarded by DTRA, contract 2007-DN-077-ER0007 awarded by DHS-DNDO, contract FA9550-08-1-0232 awarded by USAF-AFOSR, and contract DE-FG02-05ER15663, awarded by DOE. The government has certain rights in the invention.

FIELD OF THE INVENTION

The present invention generally relates to laser-based accelerators and radiation sources, and, more particularly, to the temporal and spatial alignment of such systems.

BACKGROUND OF THE INVENTION

To produce laser-driven x-ray beams, the process of inverse Compton (or Thomson) scattering of a laser pulse with a laser-accelerated electron pulse (driven by the same laser system) is used. The challenge is to overlap—in both time and space—the scattering laser beam (pulse) with the electron beam (pulse), both of which have spot-sizes that are on the micron-scale, and then to maintain their overlap reproducibly despite their tendency to drift apart. The other challenge is to measure the x-ray signal despite the large background noise produced by bremsstrahlung radiation when the high energy electron beams from the wakefield accelerator interact with solid matter (in either the electron beam dump or other objects used in the device) located in close proximity to the detector.

SUMMARY OF THE INVENTION

Electron Beams from High-Power Laser Sources

Energetic beams of electrons can be produced by laser wakefield accelerators using ultrafast (<1 picosecond), high-peak-power (>1 terawatt) lasers by creating plasma waves that accelerate electrons in high-gradient accelerating fields. These sub-picosecond laser pulses can be created from a variety of laser systems, such as those based on either the techniques of chirped pulse amplification (CPA) or optical parametric chirped pulse amplification, using such gain media as Ti:sapphire, Nd:glass, Nd:YAG, $Nd^{3+}$:YLF, BBO, LBO, KDP, and other systems recognized by those skilled in the art. These laser systems can be comprised of a single type of gain medium or multiple types of gain media, such as the crystals and glasses mentioned above, as well as fibers, diodes, and others recognized by those skilled in the art. The particular type of gain media and laser design is not critical—instead, the characteristics of the laser pulses emitted from the laser system are what is important.

To create the energetic beam of electrons, an ultrafast, high peak-power laser is focused down to micron sizes onto a target, typically a gas such as hydrogen, helium, nitrogen, or a combination of these gases that emanates from a gas jet nozzle, or combination of gas jet nozzles, although other gases, clusters, discharge ionized plasma, or even low-density solid targets (e.g., with a density between 0.001 and 0.1 g/cm$^3$) can be used. By concentrating the light from the laser into a small spot size, light intensities greater than $10^{18}$ W/cm$^2$ are achieved in the focal region.

As the laser pulse (pump laser beam) moves into the target, the leading edge of the high intensity of the laser pulse ionizes the gas, creating an underdense plasma. The interaction between the laser pulse and the plasma creates a beam of accelerated electrons (an electron beam). The ponderomotive force from the main portion of the laser pulse pushes electrons in the plasma away from the regions of highest laser intensity as the laser pulse moves through the plasma. As the laser pulse passes through the plasma, it creates a longitudinal density wave (or wake) comprised of regions with excess electrons (negatively charged regions) and regions with more ions than electrons (positively charged regions) with a phase velocity that moves at nearly the speed of light. This redistribution of electrons creates a large longitudinal electric field that can accelerate electrons trapped in this wave to high energies.

For laser wakefield acceleration, optimal conditions occur when the laser pulse duration is approximately equal to half the plasma period, or $\tau_l \approx \tau_p/2 = 2\pi/\omega_p$, where $\tau_l$ is the laser pulse duration, $\tau_p$ is the plasma period, and $\omega_p$ is the plasma frequency. As predicted by 1-D cold fluid theory, the maximum axial electric field of the relativistic plasma wave is the "wave breaking" field: $E_{WB} = (m_e c\omega_p/e)\sqrt{2(\gamma_p - 1)}$, where $m_e$ is the electron rest mass, c is the speed of light, $\omega_p = \sqrt{4\pi^2 n_{eo}/m_e}$ is the electron plasma frequency, $n_{eo}$ is the ambient electron density, e is the electron charge, $$\gamma_p = 1/\sqrt{1 - v_p^2/c^2},$$

and $v_p$ is the phase velocity of the plasma wave. For laser wakefield conditions, the maximum axial electric field of the relativistic plasma wave can exceed 1 GeV/cm.

In the so-called "bubble regime," the ponderomotive force of the laser pulse is mostly transverse (to the direction of pulse propagation), expelling almost all of the electrons at the location of the laser pulse, and leaving an ion channel. Just behind the laser pulse, the electrons that were expelled from the cavity get pulled back toward the ion channel and become effectively trapped in the first cycle of the wake wave. The high degree of beam loading effectively cancels the remaining oscillations of the wave. Under these conditions, a quasi-monoenergetic self-trapped electron beam is produced. Other methods of injecting electrons, involving multiple laser pulses (optical injection), or density discontinuities, or ionization of inner-shell electrons from small concentrations of nitrogen, can also cause electron trapping. Arbitrarily shaped gas profiles can be created along the trajectory of the focused laser pulse, by merging the gas flows from multiple gas jets/nozzles with different densities (such as by applying different backing pressures to the different gas jets), density gradients (such as by having different nozzle shapes, backing pressures, or separation distance/positions of the gas jets), and gas compositions (including using the same or different types of gas). The process of electron injection can thereby be limited to a small region, limiting the energy spread of the electron beam. Also, the processes of electron injection and electron acceleration can thereby be separately controlled. In order to achieve the maximum accelerated electron energy, the length of the plasma adjusted to match the dephasing length, which is determined by the phase velocity of the plasma wave relative to the accelerated electron velocity, the former being determined by the plasma density. The length of the plasma should not be longer than the distance over which the electrons starts to out-run the wake and thus start to lose energy. Various targets besides gas jets can be used, such as discharge-ionized plasmas (including capillary discharges).

X-Ray Beams from High-Energy Laser Sources

As discussed in more detail in U.S. Pat. No. 7,321,604 and incorporated by reference, an x-ray beam can be produced by counter-propagating an intense, ultrafast laser pulse through a beam of electrons. The laser pulse Thomson scatters off of the electron beam and frequency up-shifts to form a backscattered beam of x-rays moving in the same direction as the electron beam. In this case, the electron beam is produced through the laser wakefield method described above.

By adjusting the laser and plasma parameters (such as the laser power, intensity, and pulse duration and the plasma density and length), electron beams with different energies can be created, thereby creating a tunable electron beam source. The x-ray beam energy ($E_x$) can also be adjusted by varying the energy of the electron beam, or by varying the photon energy (hv) of the counter-propagating laser pulse (such as by using a harmonic generation crystal), according to the relation $E_x=4\gamma^2$ (hv), where $\gamma$ is the relativistic factor associated with the energy of the electron beam. For instance, an x-ray of maximum energy $E_x$=3.8 MeV can be produced by scattering a photon of energy hv=1.5 eV from an electron beam of energy 400 MeV ($\gamma$=800). The divergence angle of the x-ray beam depends on the energy of the electron beam as $\Theta\sim1/\gamma$. For a given electron beam energy, this divergence angle can be adjusted by adjusting the focusing of the scattering beam. For a scattering pulse of many optical cycles per pulse, the energy spread of the x-ray beam is roughly twice the energy spread of the electron beam. An estimate of the number of x-ray photons produced is given by the simple formula $N_{ph}=\alpha a^2 N_u N_e$, where $N_u$ is the number of electron "wiggler" or oscillation periods, $\alpha=e^2/hc=1/137$, is the fine structure constant, and a is the normalized vector potential of the focused laser field. For $N_u$=10, and a=3, this formula yields $N_{ph}\sim N_e$, the number of electrons per pulse. As discussed in more detail in U.S. Pat. No. 5,637,966 and incorporated by reference, the laser wakefield used to create the electron beam can also be created by using multiple laser pulses of different pulse durations per laser cycle that resonantly drive the plasma.

In one embodiment, the method for temporally and spatially aligning a laser-based x-ray source comprises monitoring a position of an electron beam emitted from an interaction between a pump laser beam and a plasma source; monitoring a position of the pump laser beam after the pump laser beam passes through the plasma source; adjusting the pump laser beam until the position of the pump laser beam and the position of the electron beam overlap; placing an interference material at an intersection of the pump laser beam and a scattering laser beam; monitoring an interference signal from an interaction between the pump laser beam and the scattering laser beam in the interference material; increasing the interference signal; removing the interference material from the intersection of the pump laser beam and the scattering laser beam; determining a pump laser beam alignment position using a first pump signal from a first portion of the pump laser beam that passes through a first pump laser mirror and a second pump signal from a second portion of the pump laser beam that passes through a second pump laser mirror located after the first pump laser mirror; monitoring the first and second pump signals during operation of the laser-based x-ray source; adjusting third and fourth pump laser mirrors located prior to the second pump laser mirror to move the pump laser beam back to the pump laser beam alignment position when the first and second pump signals change; determining a scattering laser beam alignment position using a first scattering signal from a first portion of the scattering laser beam that passes through a first scattering laser mirror and a second scattering signal from a second portion of the scattering laser beam that passes through a second scattering laser mirror located after the first scattering laser mirror; monitoring the first and second scattering signals during operation of the laser-based x-ray source; adjusting third and fourth scattering laser mirrors located prior to the second scattering laser mirror to move the scattering laser beam back to the scattering laser beam alignment position when the first and second scattering signals change.

In another embodiment, the method for temporally and spatially aligning a laser-based x-ray source also comprises adjusting a spatial chirp of the pump laser beam or adjusting the position of the pump laser beam relative to the plasma source.

In yet another embodiment, the method for temporally and spatially aligning a laser-based x-ray source also comprises adjusting an optical path length of the pump laser beam, adjusting an optical path length of the scattering laser beam, adjusting the position of the pump laser beam, or adjusting the position of the scattering laser beam.

In still another embodiment, the method for temporally and spatially aligning a laser-based x-ray source also comprises the step of placing a magnet after the plasma source and before the intersection of the pump laser beam and the scattering laser beam.

In another embodiment, the method for temporally and spatially aligning a laser-based x-ray source also comprises the step of placing radiation shielding around the laser-based x-ray source.

In yet another embodiment, the plasma source comprises a first gas from a first gas jet and a second gas from a second gas jet.

DETAILED DESCRIPTION OF THE INVENTION

An exemplary embodiment of the invention is described below. Those skilled in the art will recognize that variants of this exemplary embodiment can be used to practice the invention claimed.

Method for Aligning the Laser and Electron Beams in Time and Space

Figure 1:
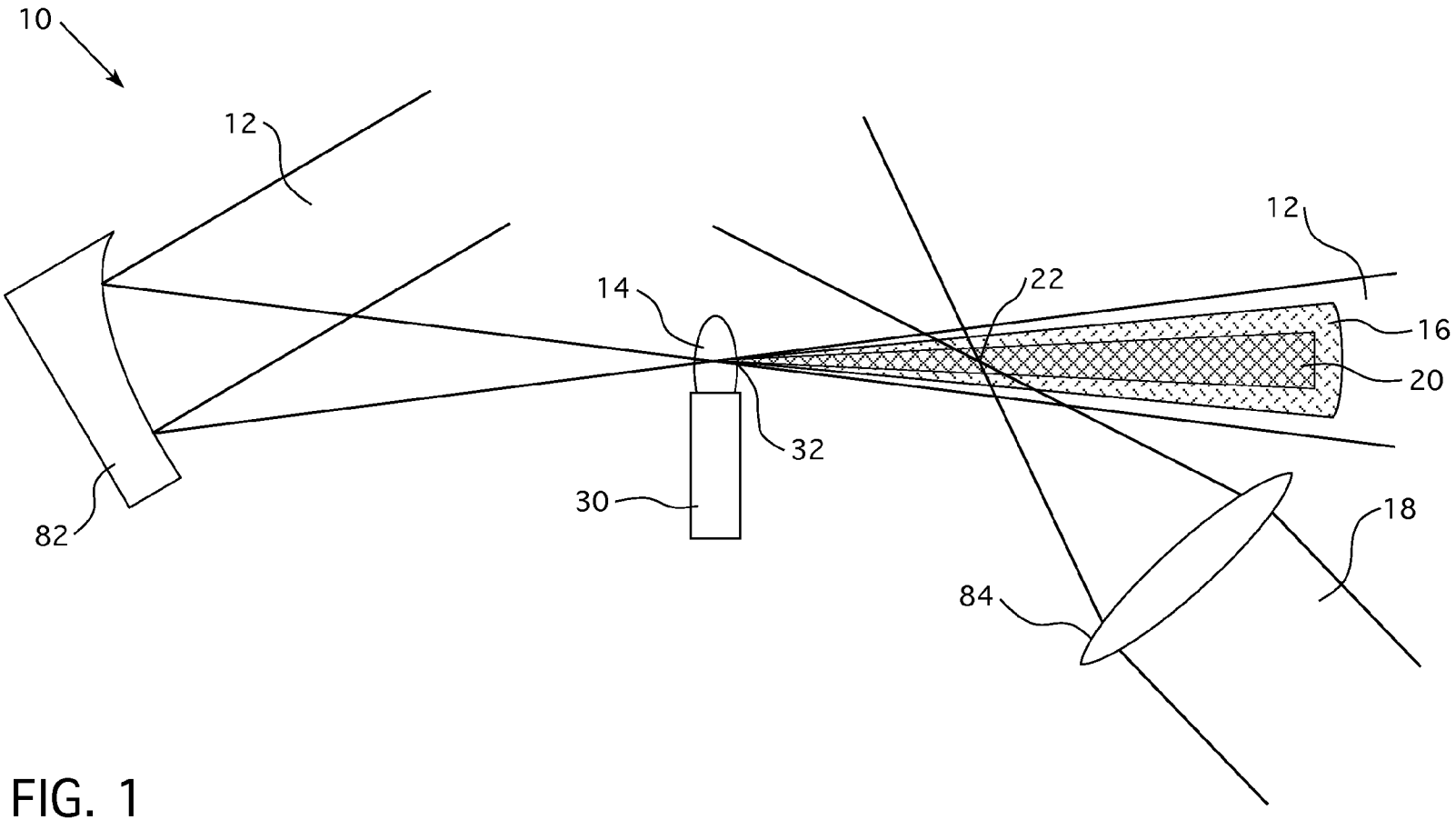
FIG. 1 is a schematic of one embodiment of a laser-based x-ray source.

As described above, a laser-based x-ray source 10 is generally comprised of a pump laser beam 12 that interacts with plasma source 14 to create a plasma wave that can trap and accelerate electrons into an electron beam 16 that emerges from this interaction. A second laser beam (scattering laser beam 18) interacts with electron beam 16 to create an x-ray beam 20. An exemplary embodiment of such a laser-based x-ray source is shown in FIG. 1.

Figure 2:
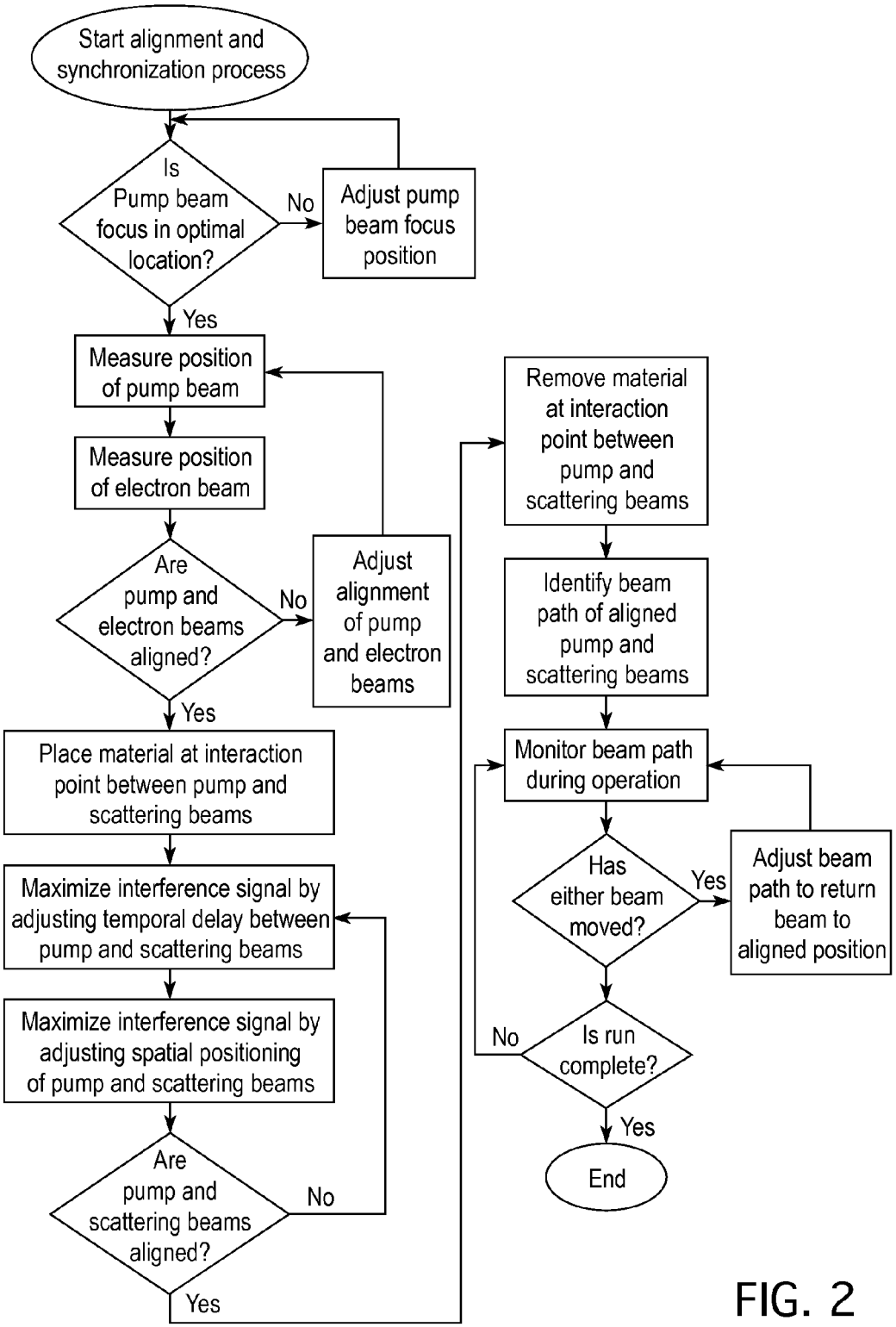
FIG. 2 is a flowchart of a method for spatially and temporally overlapping, synchronizing, and monitoring the beams in a laser-based x-ray source.

The temporal and spatial overlap of the various beams 12, 16, an 18 is important to creating an efficient and workable x-ray source. In addition, maintaining this temporal and spatial overlap over a period of time while x-ray source 10 is in operation is important to creating a stable x-ray source. The following steps (shown in more detail in FIG. 2) are taken to temporally and spatially align and overlap the various beams before operation and maintain their overlap during operation:

1. aligning pump laser beam 12 and electron beam 16 so that they are collinear with each other;
2. spatially and temporally overlapping scattering laser beam 18 and electron beam 16; and
3. aligning scattering laser beam 18 and pump laser beam 12.

Optionally, a fourth step—reducing the spectral width of x-ray beam 20—and a fifth step—reducing the detector background noise level—can be used in order to reduce or eliminate spurious x-ray noise caused by low energy electrons in electron beam 16 and other residual effects from x-ray source 10.

Each of these steps is described below in more detail, and one example of a laser based x-ray source in which these steps are used is also described in detail.

Figure 3:
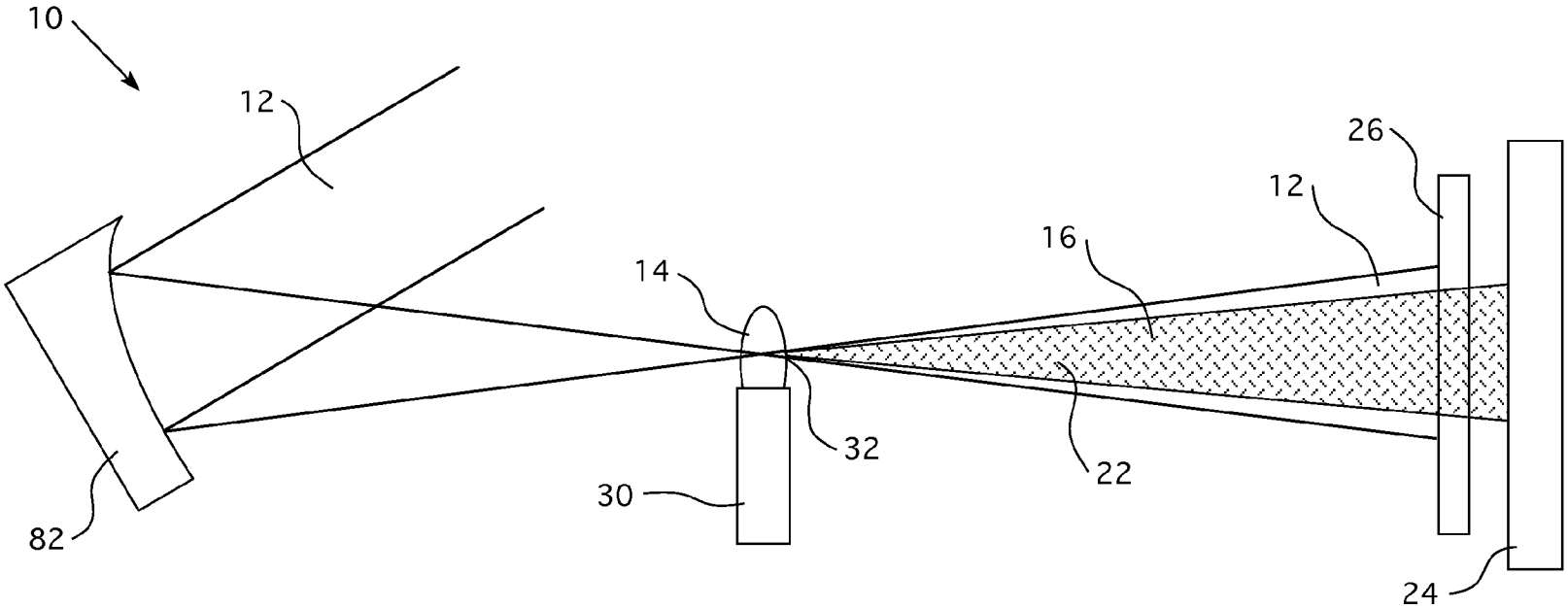
FIG. 3 is a schematic of one embodiment for spatially overlapping a pump laser beam and electron beam.

Procedure to Make the Laser Pump Beam and Electron Beam Collinear with Each Other Because the overlap alignment between laser scattering beam 18 and electron beam 16 requires measurement of the overlap of pump laser beam 12 and scattering laser beam 18 (in vacuum, without propagation of pump beam 12 through the plasma or gas 14), and yet it is the overlap of scattering beam 18 and electron beam 16 the matters for Thomson scattering, pump laser beam 12 and electron beam 16 should propagate in the same direction and their positions should be overlapped at the location of scattering intersection point 22. While electron beam 16 and pump beam 12 are overlapped in plasma 14, they can leave plasma 14 at different angles and become separated as they propagate in vacuum. One cause of this is the deflection of pump beam 12 due to the effects of refraction of the plasma or gas medium 14. Another cause is the spatial chirp of pump beam 12. In order to mitigate this problem, and assure that electron beam 16 follows pump laser beam 12, the former can be measured with an electron beam profiling detector 24 (such as an image plate), and the latter with a laser beam profiling detector 26 (such as burn paper). As shown in FIG. 3, two detectors 24 and 26 are positioned at the same location far enough downstream from intersection point 22 to accurately resolve their angular directions. Registration of the position of the beams on the two detectors 24 and 26 is assured by marking both spatially at several of the same locations. If the two beams 12 and 16 are found to not overlap spatially, then the spatial chirp of pump beam 12 is adjusted by rotating compressor gratings 28 or by adjusting the collimation of pump beam 12 before it enters compressor gratings 28 to bring the beams into alignment.

Also, pump laser beam 12 should be positioned so that it interacts with a uniform density profile, instead of a transverse density profile gradient (which can act to deflect laser light). A common source for the plasma is gas from gas jet 30 that is ionized by the leading edge of pump laser beam 12. Because gas jet 30 is a discrete source of gas, it will have a density profile that is generally the most uniform in the center. By positioning pump laser beam 12 in the middle (transversely) of the gas jet flow, the deflection of pump beam 12 can be reduced. A gas jet 30 with a flat transverse profile can be created by using a nozzle has an orifice that is wide in that dimension (large compared to the pump beam focal spot size). One of ordinary skill in the art would recognize that the plasma could be created from different sources, such as two or more gas jets, discharge-ionized plasma, or a low-density solid target, and still fall within the scope of this invention. Additionally, one of ordinary skill in the art would recognize that if gas jet 30 has a different density profile, pump beam 12 may have to be positioned at a different location that is optimal for that profile.

Figure 4:
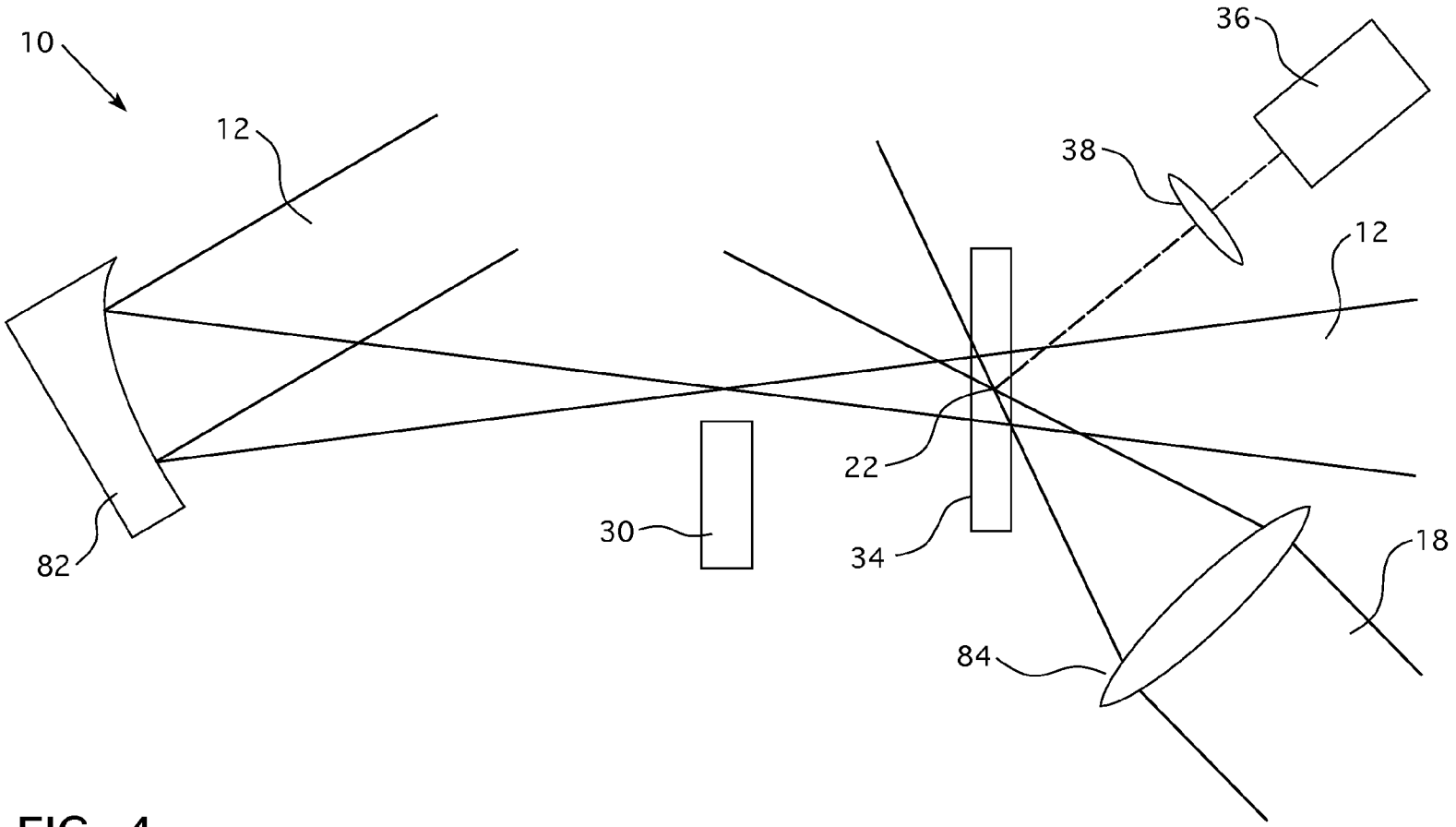
FIG. 4 is a schematic of one embodiment for spatially and temporally aligning a pump laser beam and a scattering laser beam.

Procedure for Spatially and Temporally Overlapping Laser Scattering and Electron Beams Because scattering laser beam 18 overlaps electron beam 16 near the position 32 where electron beam 16 exits the plasma accelerator, and pump beam 12 and electron beam 16 are collinear with each other, overlapping scattering laser beam 18 with pump laser beam 12 can be sufficient for alignment purposes. As shown in FIG. 4, this overlapping is accomplished by means of the interference caused by the two beams 12 and 18 in interference material 34 (such as a glass slide, BBO crystal, or non-linear harmonic generation crystal, among other materials) at the point 22 where the two beams 12 and 18 intersect. This interference can take the form of a variation in the amplitude of the beams due to the superposition of the beams (an interference pattern) or from a frequency shift in the laser light due to harmonic generation caused by the overlap of the beams. The interference between these two beams is then monitored by imaging the interference pattern/signal on CCD camera 36 located outside the chamber by use of lens imaging system 38. Alternative detectors other than a CCD camera can be used to monitor the interference signal, such as a linear array, another type of camera, or a diode, among other things. The temporal overlap between pump beam 12 and scattering beam 18 can be established by varying the temporal delay between the two beams (such as by using a delay stage or other methods to change the optical path lengths in one or both of the beams) to maximize the interference signal. The spatial overlap between the two beams can be established by varying the transverse positions of the beams with respect to each other and maximizing the interference signal. This can be done by adjusting the directions of the beams by adjusting the angular or lateral directions of their focusing optics or by placing an adjustable reflective optic after their focusing optics. By iterating this process and locating progressively increasing interference signals, one can find a maximum interference signal, which should correspondence to the proper beam alignment position. However, in some instances, it may only be necessary to adjust the temporal or the spatial overlap, but not both.

Intersection point 22 is downstream from the exit 32 of the plasma, and pump laser beam 12 is focused to a location near the entrance of the gas jet 30. Thus, the image plane of the forward imaging system should be set to the position of best focus of pump beam 12, and then translated to the location of the plane of intersection, the latter of which is also the location where scattering beam 18 is focused. Pump beam 12 will be slightly defocussed at that location, but not so much that the interference signal cannot be observed.

Procedure for Aligning Both the Scattering Laser Beam and Laser Pump Beam

Once x-ray source 10 has been aligned, it needs to be kept in alignment duration operation. In order to maintain overlap of pump beam 12 and scattering beam 18, the axes and positions of the laser beams should be kept in reproducible alignment, despite their tendency to drift out of alignment—due to movement of supporting tables and mounts, vibrations, and ambient temperature changes, among other things. In order to align both the beam's axis and position, the beams are monitored with the following arrangement of optics and CCD cameras and aligned with the following arrangement of adjustable mirrors.

Figure 5:
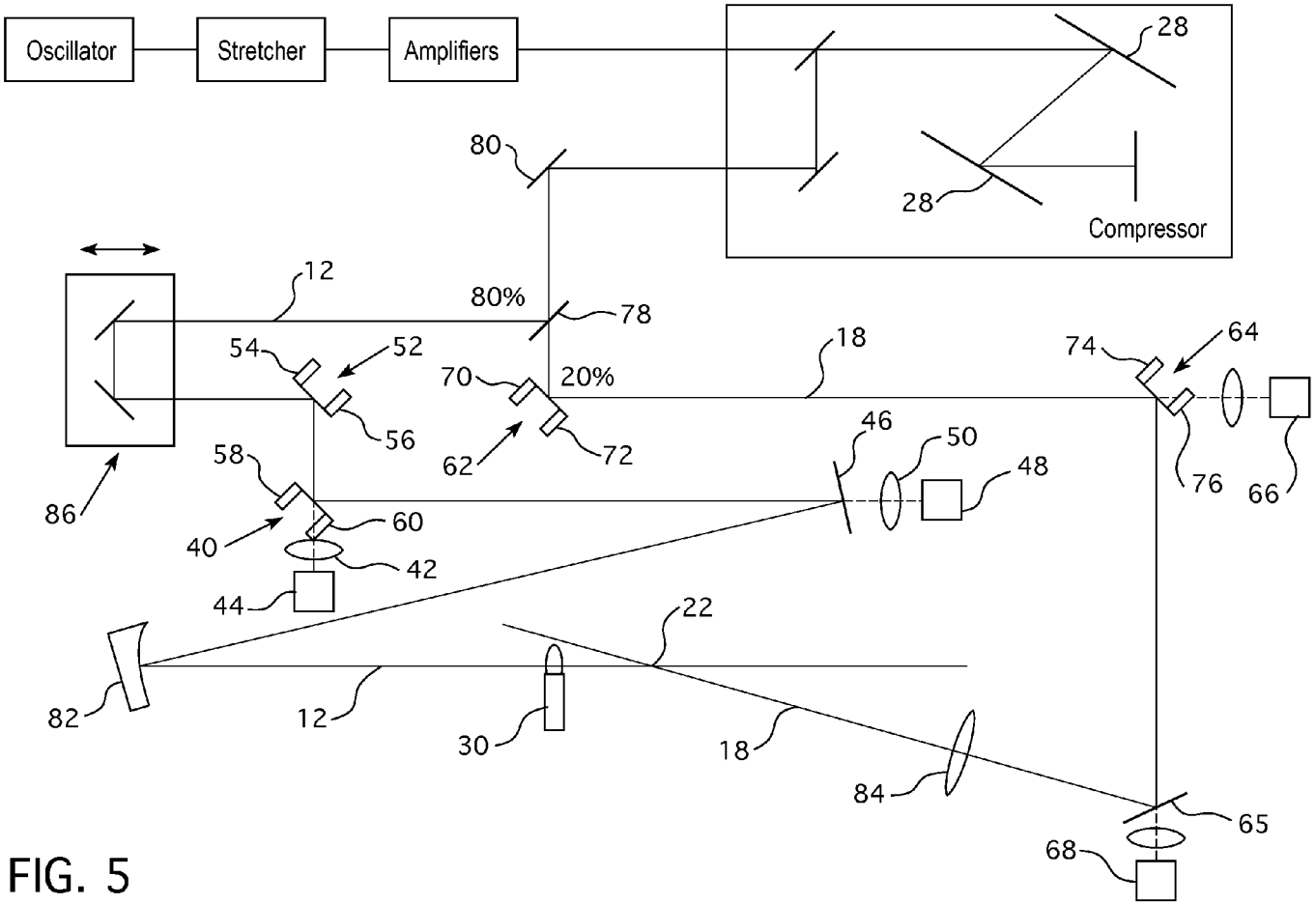
FIG. 5 is a schematic of one embodiment of a laser system for a laser-based x-ray source.

The principle is a variation on a standard procedure to align a laser beam's transverse position and axis of propagation: using two mirrors and followed by two apertures, using the first mirror to align the beam to the center of the first aperture, and using the second mirror to align the beam to the center of the second aperture. In this case, no apertures are used. Instead, a signal from the leakage of the beams through a mirror is monitored. As shown in FIG. 5, in the iris-less case, first mirror 40 has a reflectivity level that allows a small fraction of pump beam 12 to pass or leak-through it, so that the position of pump beam 12 at the location of first mirror 40 can be equivalent-plane imaged with lens 42 to CCD camera 44 (near-field image) to obtain a pump signal/image at this location. The axis is defined by positioning second mirror 46 far downstream from first mirror 40, which also allows some pass or leak-through of pump beam 12. The light that leaks through second mirror 46 is also focused onto second CCD camera 48 by lens 50, but is allowed to come to a focus (far-field image) in order to obtain a pump signal/image at this location.

The positions of the images of pump beam 12 are determined and noted, and correspond to the pump laser beam alignment position. Once the system has been fully aligned, these positions will correspond to the optimal alignment of pump beam 12.

By spatial profiling the images and determining the centroid of pump beam 12, pump beam 12 can be aligned to the same position and axis (i.e., the pump laser beam alignment position), by adjusting two mirrors 40 and 52: mirror 52 to align pump beam 12 to the centroid position on first camera 44, and mirror 40 to align pump beam 12 to the second centroid position on camera 48. Alternatively, a different mirror in the optical beam path of pump beam 12 than mirror 40 could be adjusted and fall within the scope of the invention. Computer controlled actuators 54, 56, 58, and 60 on the respective mirror mount angular controls, coupled through a feedback loop to the CCD profiling (imaging) software, can be used to continuously monitor and maintain the same position of the pump beam and, therefore, the same alignment of the laser system during operation of x-ray source 10.

The optical path for scattering beam 18 is similarly monitored with leakage through two mirrors 64 and 65, two CCD cameras 66 and 68, and computer-controlled actuators 70, 72, 74, and 76 on the mirror mount angular controls of mirrors 62 and 64 (or another mirror in the optical path of the scattering beam besides mirror 64) coupled through a feedback loop to CCD profiling software. The positions of the images of scattering beam 18 are determined and noted, and correspond to the scattering laser beam alignment position. Once the system has been fully aligned, these positions will correspond to the optimal alignment of scattering beam 18.

Thus, once these pump and scattering beam alignment positions are determined, they can be monitored during operation of x-ray source 10. If either beam deviates from this optimal alignment position, the actuators can return the beams to their proper alignment positions during operation of x-ray source 10. Alternatively, x-ray source 10 could be shut down once the alignment positions deviate from a set tolerance range to allow the operators to realign the system.

While CCD cameras are used in this embodiment to monitor the beam signals, other detectors, such as another type of camera, diode, or other light-sensitive device could also be used to obtain a signal/image of respective beams from the portion of the beams that pass through their respective mirrors.

Procedure to Reduce the X-Ray Beam's Spectral Width

Figure 6:
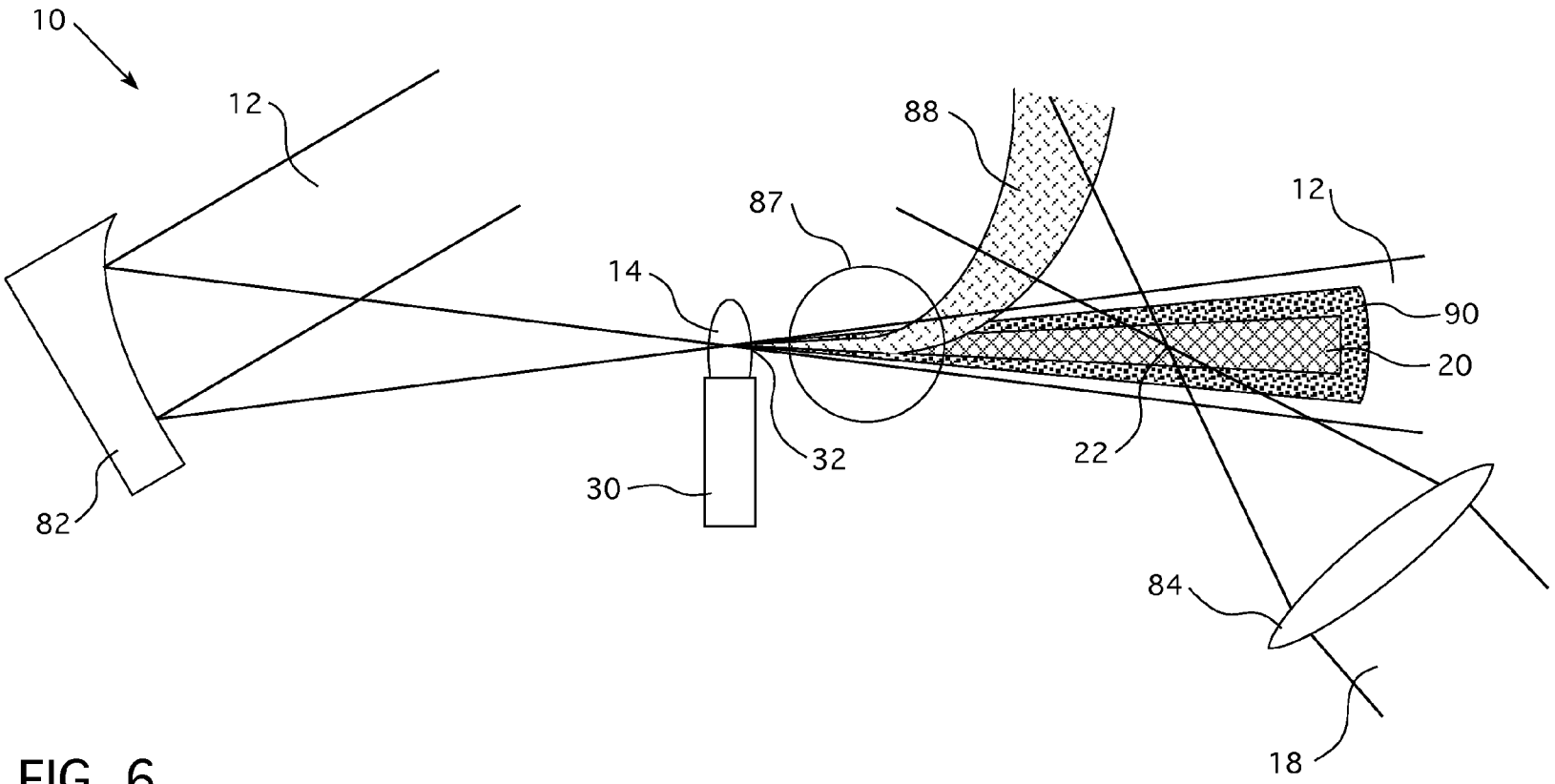
FIG. 6 is a schematic of one embodiment for removing low-energy electrons in a laser-based x-ray source.

High-charge electron beams accelerated by laser wakefields often have relatively large energy spreads, resulting in a correspondingly large x-ray spectral width. It is possible to reduce the x-ray beam's spectral width, if it can be arranged for the scattering laser beam to scatter only from the higher energy electrons, but not the lower energy electrons in the tail of the energy distribution. This reduction can be accomplished by placing the beam in a strong magnetic field 87 from a dipole or multipole magnet immediately after electron beam exit 32 from the plasma, as shown in FIG. 6. Doing so will act to angularly disperse the electrons in electron beam 16 according to their energies. After propagation over sufficient distance from the exit of the plasma to the scattering interaction point, the low energy portion 88 of the beam will be well separated spatially from the high-energy portion 90, and will miss scattering beam 18 at interaction point 22. In such a configuration, inverse Compton scattering will not produce the low energy tail in the x-ray photon energy distribution that it would otherwise.

Procedure for Reducing Detector Background Noise to a Level Below the Signal Level In order to prevent noise from x-rays produced by bremsstrahlung emitted when the electron beam hits solid objects such as the magnet walls, the vacuum chamber walls (or vacuum windows), or the beam dump, the x-ray detector should be shielded from these noise sources by placing a sufficient quantity of absorbers (such as lead bricks, boron, plastic, aluminum, copper or other such materials or combinations of these materials) between the noise sources and the detector, along the line-of-sight to the detector. Other methods of shielding or redirecting the x-ray and electron noise recognized by those skilled in the art could be used, as well.

One Embodiment of the Invention

Experiments involving an embodiment of the invention were performed using the Diodes 100 TW, Ti:Sapphire based laser system, which operated at a repetition rate of 10 Hz and a central wavelength of 800 nm. As shown in FIG. 5, the experiment used beam splitter 78 to split a 2.4 J beam into a pump pulse 12 and a scattering pulse 18 with an energy ratio of approximately 80% and 20%, respectively. A deformable mirror 80 corrected the wavefront and improved the focal quality of both beams. As shown in FIG. 1, the 1.9 J, 35 fs pump beam 12 was focused above a 2 mm gas jet 30 by a 1 m focal length parabolic reflector 82. The peak intensity on target was $7.2\times10^{18}$ W/cm$^2$, corresponding to a normalized vector potential of $a_0$=1.8. The 0.5 J, 90 fs scattering beam 18 was focused to a 22 micron FWHM spot size by a 1 m focal length lens 84 giving a peak focused intensity $3.4\times10^{17}$ W/cm$^2$. The laser energy contained in the wings around the focal spot reduced the peak intensity by 35% of what was expected for a perfect laser beam. Material dispersion in the beam splitter and lens accounted for the increased pulse duration in scattering pulse 18.

The leading edge of pump pulse 12 ionized a gas mixture of 99% Helium and 1% Nitrogen from gas jet 30 to create plasma 14 with a density of $4\times10^{18}$ cm$^{-3}$. Electron beam 16 was emitted from plasma source 14 due to the interaction between pump pulse 12 and plasma 14.

As shown in FIG. 3, pump pulse 12 and electron beam 16 were aligned using electron beam detector 24 (such as camera film, a fluorescent screen (LANEX), or an image plate) and laser profile detector 26 (such as burn paper or a fluorescent screen). Laser profile detector 26 was placed in front of electron beam detector 24, and the position of pump pulse 12 was compared to an imaged signal from electron beam detector 24. Gas jet 30 was positioned using a three-dimensional translation stage such that pump pulse 12 focused at the center of the front of the gas emitted from gas jet 30 and, therefore, the most uniform region of gas. The spatial chirp of pump pulse 12 was adjusted by varying the collimation of pump pulse 12 as it entered compressor gratings 28 or by rotating compressor gratings 28. The beam-positioning mirrors were adjusted by means of translation or rotation. These adjustments were made until pump pulse 12 and electron beam 16 overlapped on detectors 24 and 26. At this point, pump pulse 12 and electron beam 16 were in alignment.

Next, scattering beam 18 and electron beam 16 were aligned by aligning scattering beam 18 to pump beam 12 (which was known to be in alignment with electron beam 16). The overlap of the laser scattering beam 18 and electron beam 16 was performed in a counter-propagating geometry with a 10-degree angle between the two beams in the horizontal plane, as shown in FIG. 4. Delay stage 86 on the pump beam 12 line was used to adjust the path length, relative to scattering beam 18, with micron accuracy, thereby adjusting the timing between scattering beam 18 and pump beam 12/electron beam 16. Alternatively, delay stage 86 could be placed in the beam path of scattering beam 18 to adjust the relative timing between the beams. Spatio-temporal overlap was performed at the focus of the scattering beam (interaction point 22), which was located 1 mm after the gas nozzle and 3 mm after the pump beam focus, by inserting an interference material 34 (such as a glass slide or nonlinear harmonic generation crystal such as BBO, among other materials) at interaction point 22 to create an interference signal. This signal was imaged using imaging system 38 and CCD 36.

By adjusting delay stage 86, the timing between pump pulse 12 and scattering pulse 18 could be varied to obtain a maximum interference signal, which corresponded to the optimal temporal overlap. The interference signal was further maximized by adjusting the spatial position of the focus of scattering pulse 18 (by adjusting the longitudinal position of the focusing element 84) until pump pulse 12 and scattering pulse 18 were maximally overlapped. The process was iterated until the interference signal was maximized, although a single pass through this process was sufficient in some circumstances. For the overlap techniques used, the two laser beams focal spot overlap uncertainty in the vertical axis was a quarter of the scattering beam spot size and was determined by the shot-shot jitter of the laser. The temporal overlap uncertainty was 15 femtoseconds, which was much smaller than the 300 fs crossing time of the two beams.

The position of pump beam 12 was monitored using the leakage of light through mirrors 40 and 46. Behind each of these mirrors was imaging systems 42 and 50 and CCDs 44 and 48. Similarly, the position of scattering beam 18 was monitored using the leakage of light through mirrors 64 and 65 and CCDs/imaging systems 66 and 68. Once the three beams were found to be in alignment, the optimal positions of pump beam 12 and scattering beam 18 were noted on CCDs 44, 48, 66, and 68.

The alignment of the three beams was maintained using computer-controlled CCD profiling software coupled to horizontal and vertical actuators 54, 56, 58, 60, 70, 72, 74, and 76 on mirrors 40, 52, 62, and 64 in the beam lines for pump beam 12 and scattering beam 18. As any of the images began to drift from the optimal alignment position during operation of x-ray source 10, these actuators engaged to return the beams to their optimal alignment positions.

Background Mitigation

Figure 7:
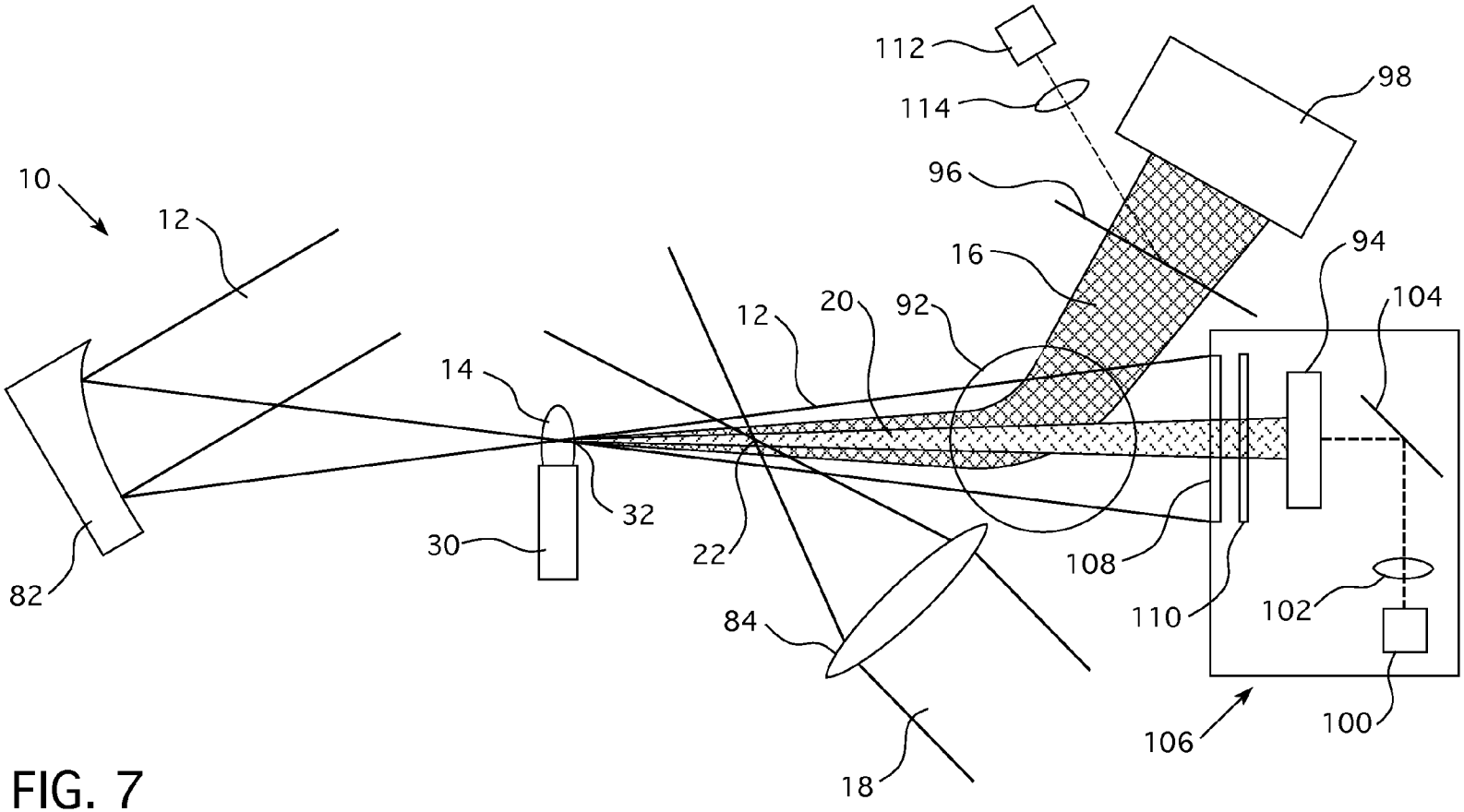
FIG. 7 is a schematic of one embodiment for characterizing the electron beam and x-ray beam in a laser-based x-ray source.

As shown in FIG. 7, to minimize background bremsstrahlung radiation arising from the laser wakefield accelerated electrons, a round magnet 92 with a diameter of 140 mm and a peak magnetic field of 0.8 Tesla deflected electron beam 16 from the path of the scintillate detector 94 while simultaneously monitoring the electron beam spectrum with a Lanex screen 96 placed about 30 cm away from magnet 92 inside the vacuum chamber. The deflected electrons were further dumped in a 12 cm thick Teflon block 98 placed inside the vacuum chamber. On the outside of the vacuum chamber, a lead shield was placed to shield bremsstrahlung and other sources of unwanted signal when the electrons were dumped in the chamber. A baffle made of lead shield was also placed in front of the scintillator to shield line of sight to the detector from any spray of electrons producing high-energy photons when they hit the metal walls of the cylindrical magnet 92. The magnetic spectrometer with Lanex scintillating screen 96 were kept in place to observe the e-beam energy spectrum which generates Thomson gamma rays during the experiment using CCD camera 112 and imaging system 114.

Detection

The e-beam spectrum was poly-energetic with a high-energy tail extending to an energy of 350 MeV generated from 99% Helium and 1% Nitrogen mixed gas with a plasma density of $4\times10^{18}$/cm$^3$. The beam contained 120 pC of total integrated beam charge across energies above 50 MeV.

The generated γ-ray was detected by CsI(Ti) crystal scintillator array 94 coupled to a 14-bit electron multiplication charge coupled device (EMCCD) Rolera-MGI plus camera 100. CsI(Ti) crystal scintillator 94 consisted of 1 cm deep 40×40 voxel arrays, each 1.0×1.0×10 mm, with a 0.2 mm epoxy layer between voxels. The 0.2 mm epoxy layer between voxels ensured optical cross talk was minimized between voxels. With an additional 1.6 mm epoxy border and 1 mm epoxy layer at rear, the overall dimension of the CsI(Ti) crystal 94 was 51×51×11 mm. While a CsI(Ti) crystal scintillator array was used in this experiment, other types and dimensions of detectors could also be used. The EMCCD Rolera MGI plus camera 100 was an array of 512×512 16 μm pixels, and was coupled to a Nikon 50 mm f#/1.2 lens 102 enabling the detection of 5.1×5.1 cm$^2$ surface of CsI(Ti) scintillator 94. A 45-degree mirror 104 placed in between CsI(Ti) crystal 94 and the CCD camera 100 folded the image of CsI crystal 94 by 90 degrees. The 90-degree configuration of CCD 100 with respect to face of CsI(Ti) crystal 94 ensured no direct electrons generated at the source hit the CCD camera 100 and minimized unwanted background signal. The whole detection system was housed in a light tight Aluminum box 106 to minimize background from scattered laser and room light. The count rate with the camera cap on and off was comparable. Light tight box 106 was made of a 1" thick Aluminum. To reduce scattering and block scattered laser light, the entrance 108 of light tight box 106 was made of thinner (500 μm) aluminum. The system was calibrated by using a 137Cs radioisotope source delivering a 5680 $mm^{-2}$ $s^{-1}$ photon flux at the face of CsI(Ti) crystal 94. The calibration at this energy resulted in 179.1 counts/photon (one gamma ray photon results about 179 counts on the EMCCD camera 100) when operated at the highest gain (4095). Using the calibration at 662 keV, the count per photon for any other photon energy was obtained by using the gamma-ray absorption curve in CsI(Ti), which can be found in the NIST X-COM database.

The simulated CsI image was then obtained using Monte Carlo method to calculate the gamma ray transportation and response of CsI detector 94. The simulated result showed a good agreement with the experiment profile.

To estimate energy of x-rays, a quad filter 110 (crossed plates of 1.7 mm lead and 3.4 mm lead) was placed in front of CSI detector 94. With one quadrant uncovered, the transmittance of each of the rest of the three quadrant filters was determined. These experimental values were compared with theoretical ones and calculated as a convolution of test x-ray spectra (Lorentz shape, 0.1 MeV width), filter transmittance curve, and CSI response curve (which gives a number of counts per image pixel for incident photon as a function of photon energy). The central energy of the estimated x-ray spectra was varied to find the best match. The difference between the simulated and measured result was within the measured error.

To prove that x-ray signal originated from Thomson scattering, and therefore correlated with scattering beam presence, nearly 400 laser shots were made with scattering beam 18 blocked. A Thomson signal 20 was not observed in these experiments. From statistical point of view it means that with 98% confidence level the probability to see x-ray signal without scattering beam was less than 1% (assuming Poisson distribution for such probability).

The gamma ray and electron source size were characterized with the spatial cross correlation technique. The laser focus spot was scanned vertically at interaction point 22 across the electron beam in steps of 5 μm over the range of ±40 μm while recording the gamma ray signal on the detector. Each data point was extracted from a single shot intensity profile on the detector plane with a background subtraction for each scan position. The figure exhibited a clear signature of the spatial cross correlation profile between the electron and laser pulses. When two pulses were separated by radial distance r, the total gamma ray signal detected was proportional to the convolution of the vertical profiles of the two pulses. The profile of X-ray signal was generally described by a convolution integral over the intensity profiles of the electron and laser pulses, $I_{signal}(r) = \int_{-\infty}^{\infty} I_e(r')I_L(r'-r)\,dr'$, where $I_e$ and $I_L$ are the intensity profiles of electron and laser pulses respectively. By assuming that pulse shape was a Gaussian Profile for both laser and electron, the width the cross correlation profile, $$\sigma_{signal} = \sqrt{\sigma_e^2 + \sigma_L^2},$$

was obtained, where $\sigma_e$ and $\sigma_L$ are Gaussian widths of electron and laser beams at the interaction point respectively. A Gaussian profile was fitted to the data points and the best fit was obtained with a FWHM of 26.1±3.2 μm ($\sigma_{signal}$=11.1 μm). Knowing the spatial width of the laser pulse (FWHM 22±1 μm) and width of the cross correlation trace, the electron beam size (assumed as the source size of gamma ray) was estimated to be FWHM of 13.2±6.2 μm or $\sigma_e$=5.6±1.3 μm by deconvolution of the cross correlation curve. The 46.9% error in measurement was found by error propagation between cross correlation trace and laser focal spot variation, and the former was dominantly attributed to the measured relative position jittering of Δr=±5 μm which is about 22% of laser focal spot and 38% of electron beam sizes at IP. Therefore, the fluctuations of the gamma ray intensity during the scanning process were caused by fluctuations of both laser and electrons beam spatial positions.

The electron beam size at the interaction point at a distance of 1 mm±0.25 mm from the exit of gas jet was also calculated to be 3.8±6.7 μm by interpolating the measure beam size and divergence.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

What is claimed is:

1. A method for temporally and spatially aligning a laser-based x-ray source, the method comprising:

monitoring a position of an electron beam emitted from an interaction between a pump laser beam and a plasma source;

monitoring a position of the pump laser beam after the pump laser beam passes through the plasma source;

adjusting the pump laser beam until the position of the pump laser beam and the position of the electron beam overlap;

placing an interference material at an intersection of the pump laser beam and a scattering laser beam;

monitoring an interference signal from an interaction between the pump laser beam and the scattering laser beam in the interference material;

increasing the interference signal;

removing the interference material from the intersection of the pump laser beam and the scattering laser beam;

determining a pump laser beam alignment position using a first pump signal from a first portion of the pump laser beam that passes through a first pump laser mirror and a second pump signal from a second portion of the pump laser beam that passes through a second pump laser mirror located after the first pump laser mirror;

monitoring the first and second pump signals during operation of the laser-based x-ray source;

adjusting third and fourth pump laser mirrors located prior to the second pump laser mirror to move the pump laser beam back to the pump laser beam alignment position when the first and second pump signals change;

determining a scattering laser beam alignment position using a first scattering signal from a first portion of the scattering laser beam that passes through a first scattering laser mirror and a second scattering signal from a second portion of the scattering laser beam that passes through a second scattering laser mirror located after the first scattering laser mirror;

monitoring the first and second scattering signals during operation of the laser-based x-ray source;

adjusting third and fourth scattering laser mirrors located prior to the second scattering laser mirror to move the scattering laser beam back to the scattering laser beam alignment position when the first and second scattering signals change.

2. The method of claim 1, wherein the plasma source comprises gas from a gas jet.

3. The method of claim 2, wherein the gas comprises hydrogen.

4. The method of claim 2, wherein the gas comprises helium.

5. The method of claim 2, wherein the gas comprises nitrogen.

6. The method of claim 2, wherein the gas is comprised of a mixture of two different gases.

7. The method of claim 1, wherein the plasma source comprises a first gas from a first gas jet and a second gas from a second gas jet.

8. The method of claim 7, wherein the first gas and the second gas are the same type of gas.

9. The method of claim 7, wherein the first gas is at a different pressure than the second gas.

10. The method of claim 7, wherein the first gas and the second gas merge to create regions of different gas densities along the pump laser beam.

11. The method of claim 1, wherein the plasma source comprises clusters.

12. The method of claim 1, wherein the plasma source comprises a discharge ionized plasma.

13. The method of claim 1, wherein the plasma source comprises a laser-ionized solid target with a density between 0.001 and 0.1 grams per cubic centimeter.

14. The method of claim 1, wherein the step of adjusting the pump laser beam until the position of the pump laser beam and the position of the electron beam overlap comprises adjusting a spatial chirp of the pump laser beam.

15. The method of claim 1, wherein the step of adjusting the pump laser beam until the position of the pump laser beam and the position of the electron beam overlap comprises adjusting the position of the pump laser beam relative to the plasma source.

16. The method of claim 1, wherein the interference material comprises glass.

17. The method of claim 1, wherein the interference material comprises a nonlinear harmonic generation crystal.

18. The method of claim 1, wherein the interference signal comprises an interference pattern.

19. The method of claim 1, wherein the interference signal comprises a frequency-shifted light signal.

20. The method of claim 1, wherein the step of increasing the interference signal comprises adjusting a relative timing between the pump laser beam and the scattering laser beam.

21. The method of claim 20, wherein the step of adjusting the relative timing between the pump laser beam and the scattering laser beam comprises adjusting an optical path length of the pump laser beam.

22. The method of claim 20, wherein the step of adjusting the relative timing between the pump laser beam and the scattering laser beam comprises adjusting an optical path length of the scattering laser beam.

23. The method of claim 1, wherein the step of increasing the interference signal comprises adjusting the position of the pump laser beam.

24. The method of claim 1, wherein the step of increasing the interference signal comprises adjusting the position of the scattering laser beam.

25. The method of claim 1, wherein the interference signal is an image from a camera.

26. The method of claim 1, wherein the first pump laser mirror is also the fourth pump laser mirror.

27. The method of claim 1, wherein the first scattering laser mirror is also the fourth scattering laser mirror.

28. The method of claim 1, wherein the pump laser beam alignment position and the scattering laser beam alignment position comprise positions of optimal alignment of the laser-based x-ray source.

29. The method of claim 1, further comprising a step of placing a magnet after the plasma source and before the intersection of the pump laser beam and the scattering laser beam.

30. The method of claim 29, wherein the magnet is a dipole magnet.

31. The method of claim 29, wherein the magnet is a multipole magnet.

32. The method of claim 1, further comprising a step of placing radiation shielding around the laser-based x-ray source.

33. The method of claim 32, wherein the radiation shielding comprises lead.

34. The method of claim 32, wherein the radiation shielding comprises boron.

35. The method of claim 32, wherein the radiation shielding comprises plastic.

36. The method of claim 32, wherein the radiation shielding comprises aluminum.

37. The method of claim 32, wherein the radiation shielding comprises copper.

* * * * *